US007143534B2

(12) United States Patent
Kaminski

(10) Patent No.: US 7,143,534 B2
(45) Date of Patent: Dec. 5, 2006

(54) SIGN HOLDER

(75) Inventor: Douglas J. Kaminski, West Wyoming, PA (US)

(73) Assignee: Metro Industries Inc., Reno, NV (US)

( * ) Notice: Subject to any disclaimer, the term of this patent is extended or adjusted under 35 U.S.C. 154(b) by 42 days.

(21) Appl. No.: 10/702,474

(22) Filed: Nov. 7, 2003

(65) Prior Publication Data

US 2005/0097796 A1 May 12, 2005

(51) Int. Cl.
*G09F 15/00* (2006.01)

(52) U.S. Cl. ..... 40/606.15; 40/606.08; 248/274.1

(58) Field of Classification Search ..... 40/606.01, 40/606.08, 606.15, 606.03, 606.14, 601; 248/316.8, 201, 274.1; 108/6, 9; 211/144, 211/163, 165, 170, 171
See application file for complete search history.

(56) References Cited

U.S. PATENT DOCUMENTS 2,504,556 A * 4/1950 Luitjens et al. ..... 40/606.15
3,757,705 A * 9/1973 Maslow ..... 108/147.13
5,718,072 A * 2/1998 Garfinkle ..... 40/606.15
5,803,420 A * 9/1998 Conway et al. ..... 40/606.15
6,318,684 B1 * 11/2001 Ireland et al. ..... 40/606.15
6,378,818 B1 * 4/2002 Padiak et al. ..... 40/606.15
6,665,969 B1 * 12/2003 Conway ..... 40/606.15
6,796,064 B1 * 9/2004 Gibson et al. ..... 40/606.15
2001/0010134 A1 * 8/2001 Shoemaker et al. ..... 40/607

* cited by examiner

*Primary Examiner*—Gary C. Hoge
(74) *Attorney, Agent, or Firm*—Fitzpatrick, Cella, Harper & Scinto

(57) ABSTRACT

The present disclosure provides a sign holder for displaying a sign relative to a workstation. The sign holder has a support pivotably coupled to an arm. The arm in turn is pivotably coupled to a signboard. The sign holder may be pivoted between a first position to provide enhanced visibility and a second position to increase the available workspace at the work station while maintaining visibility of the sign.

28 Claims, 5 Drawing Sheets

SIGN HOLDER

BACKGROUND OF THE INVENTION

Field of the Invention

The present invention relates to a sign holder, and more particularly to a sign holder that may be moved between a first prominently displayed position and a second retracted position.

Signs are commonly posted on walls, cabinets, or other surfaces in ready view of users or passersby to relay information such as text or pictures. The information may be printed, painted, etched, embossed, or otherwise placed onto a medium such as paper, plastic, or the like. Paper stock is desirable in many applications because it can be easily and cheaply manufactured. Signs are commonplace and used in almost any environment where it is desirable to relay information to individuals.

Signs may be adhered via tape, glue or paste to a support surface or may be mechanically attached, for example, by mechanical fasteners like staples, tacks, rivets, screws or nails, to the support surface. Although affixing signs using adhesive or mechanical fasteners is common, these means also have several drawbacks. For instance, adhesives are unreliable. In some cases the adhesive may work too well and become difficult to remove. When trying to remove the adhesive, damage to the sign and/or support surface may result. In other cases, the adhesive may prove to be inadequate and result in premature failure of the bond. Mechanical attachment for signs often require the use of a support surface that can be pierced, which limits the potential surfaces that may be used to display these signs. All too frequently, a suitable support surface which may be pierced is located in a less than optimal location having reduced visibility. Even if such a support surface is available, many times it is not desirable to repeatedly remove the mechanical fastener. Doing so results in holes and other similar damage to the sign and/or support surface.

One environment in which signs have proven to be particularly useful is in restaurant kitchens to display work instructions for employees. In a pizza restaurant, for example, signs may be used to show and remind workers of the appropriate crust color, and the proper ingredients. These signs have been found to be particularly helpful in training new employees, who are often instructed during slower shifts. It also is common for many restaurants to experience almost constant employee turnover. Therefore, it is necessary to be able to quickly and efficiently train new employees in order to produce a consistent product.

In restaurants such as those described, it is common to have a food preparation table with an upwardly extending splashguard along the rear table edge. Many times signs are displayed on the splashguard in ready view of employees as they work. As described above, when the sign is attached via adhesive, it is undesirable to remove the signs repeatedly due to potential damage to the sign and/or splashguard. This becomes particularly problematic when it is desirable to switch signs to educate the employees regarding new products, highlight problem areas, or display special announcements. During busy shifts, the sign may also become soiled or damaged as the employees work since it is located on the splashguard of the table where food is prepared. Further, signs mounted on the splashguard often become obscured behind other objects placed on the table while the employees are working, thereby reducing the visibility of the sign. Still further if the means for attaching the sign to the splash guard fail, the sign may fall into the food preparation area.

One known device for mounting a sign is disclosed in U.S. Pat. No. 3,969,838 to Moore and includes a generally flat surface that is bounded at opposite ends by a pair of elongate channels. The sign holder is supported via a cantilevered arm or a bottom standard secured to a wall or support by a screw. The Moore Patent suggests that this device has particular applicability for displaying information regarding merchandise in stores and markets, because the elongate channels permit many different signs to be inserted and removed at the option of the user.

Although the sign holder disclosed in the Moore Patent overcomes some of the disadvantages noted above, several drawbacks remain. For example, the sign holder may only be conveniently secured in a single location. To reposition that sign holder, the user would need to remove the mounting screws, relocate the sign holder, and then retap the screws at the new location. Although signs may be easily inserted and removed, the device described in the Moore Patent merely transfers the problems highlighted above with respect to the sign to the sign holder.

Moreover, in the restaurants such as the pizza restaurant discussed above, it is undesirable for employees to expend the time and effort necessary to remove a sign holder made in accordance with the Moore Patent in order to provide additional workspace for food preparation. Due to the time involved, it is unlikely that such a device would be moved. Accordingly, the sign holder described in the Moore Patent is likely to become soiled or damaged during busy shifts. Alternatively, the sign holder could be mounted a distance from the food preparation table. However, doing so would diminish the visibility of the sign. This overall lack of mobility substantially limits the desirability of using the device described in the Moore Patent in restaurants or in other similar applications.

In light of the above points, it is desirable to have a sign holder that can easily accept different signs. It is be desirable to have a sign holder that can be mounted near the employee's workspace without being obscured by other objects, thereby increasing the visibility of the sign. It is further desirable to have a sign holder that may be moved between two positions: one position which provides easy reference to the sign and a second position which maximizes the available workspace while maintaining visibility of the sign.

SUMMARY OF THE INVENTION

In accordance with the teachings of the present invention, a sign holder for displaying a sign is constructed so it can be secured to a support member, such as a pole or post, in a desired location. In particular, the sign holder includes a mounting bracket that is coupled to the post or pole. The bracket may be coupled through a variety of means such as by a weld, adhesive, bolt, screw, nail, or other mechanical attachment device designed to secure objects together.

In accordance with a preferred embodiment, an arm is pivotably connected to the mounting bracket through a first pivot coupling. The pivot coupling may be a pin, rivet, screw, bolt, or boss on either the bracket or the arm which engages a hole or cylindrical coupling sleeve on the other of the support and arm. The pivot coupling may also include a bearing assembly such as a magnetic bearing, ball bearing, or hydraulic bearing assembly fitted between the bracket and arm to reduce friction. The arm in turn is pivotably connected to a signboard by a second pivot coupling to permit pivoted movement between the signboard and the arm. The signboard is configured to removably receive different signs. In use, the arm may be pivoted between a first position wherein the sign holder and any mounted sign are supported more closely to a worker in front of the table thereby to enhance visibility of the sign, and a second position wherein the sign holder and sign are pivoted away from the worker to maximize the available workspace.

Further areas of applicability of the present invention will become apparent from the detailed description provided hereinafter. It should be understood that the detailed description and specific examples, while indicating preferred embodiments of the invention, are intended for purposes of illustration only.

BRIEF DESCRIPTION OF THE DRAWINGS

The present invention will become more fully understood from the detailed description and the accompanying drawings, wherein.

DETAILED DESCRIPTION OF A PREFERRED EMBODIMENTS

The following description of certain preferred embodiments is merely exemplary in nature and is in no way intended to limit the invention, its application, or uses.

Figure 1:
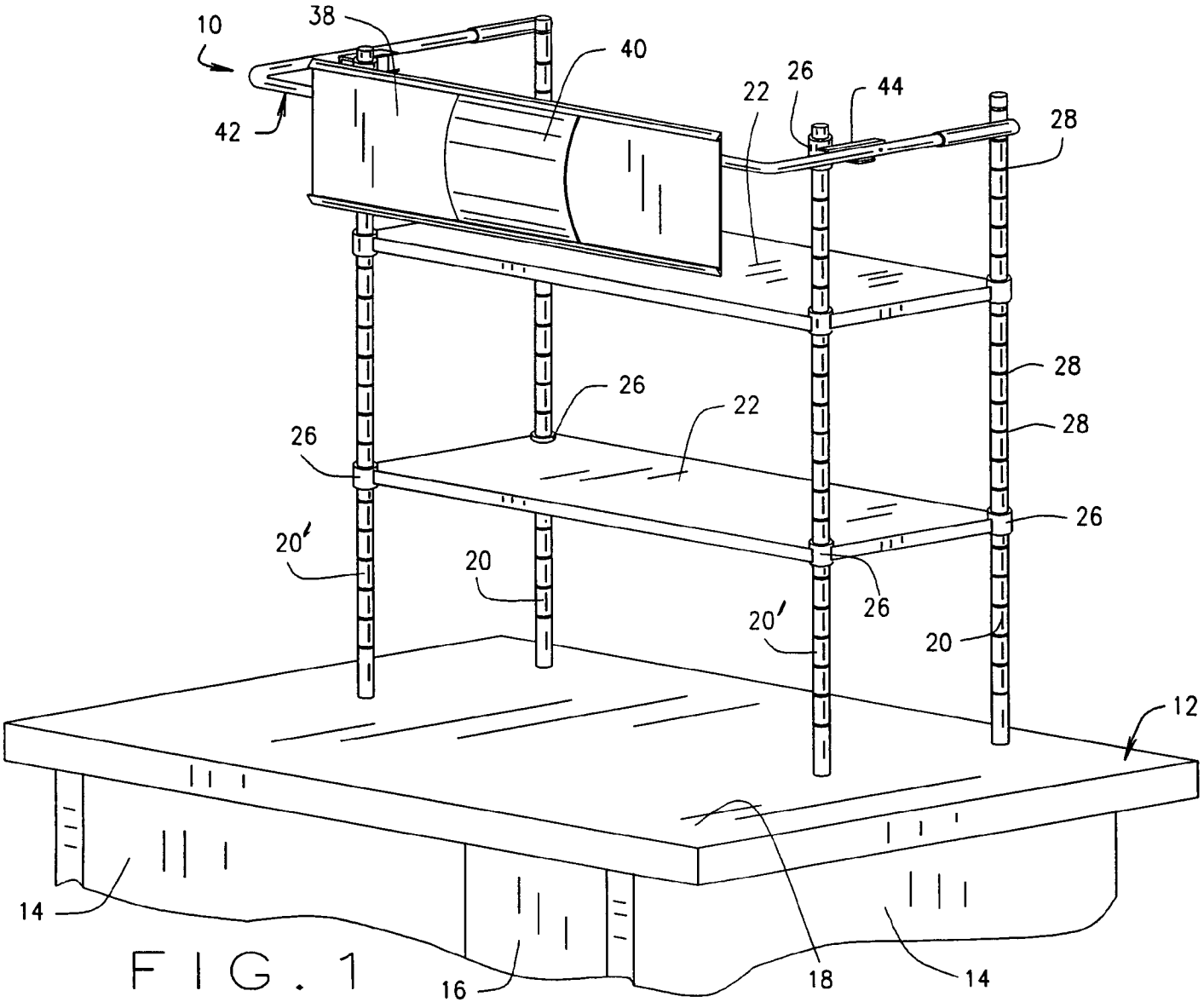
FIG. 1 is a perspective view of a sign holder constructed in accordance with the present invention, associated with a workstation and positioned in a first position.

FIG. 1 illustrates an exemplary sign holder 10 according to the present invention as it is mounted on a workstation 12. The workstation may have any of a large variety of configurations. However, the workstation shown in FIG. 1 includes a tabletop 18 or other similar work surface supported by a pair of side walls 14 and a rear wall 16. Four upstanding members in the form of vertical support posts 20 are carried on the tabletop 18. The posts 20 may be free-standing or affixed to the tabletop 18, or a pair of shelves 22 can be carried between the posts 20 thereby to hold them in the fixed relationship shown. Desirably the posts 20 are cylindrical in horizontal cross-section and have a plurality of spaced annular grooves 24. Each shelf 22 is mounted on the four support posts with a split sleeve and conical collar structure 26 such as that described in U.S. Pat. Nos. 3,424,111; 3,523,508; 3,604,369; and 3,757,705, which are incorporated by reference into the present specification. This structure is described in detail in the patents referred to above and is used to mount shelves and similar structures to support posts in a product called SUPER ERECTA® shelving sold by InterMetro Industries Corporation of Wilkes-Barre, Pa.

Figure 2:
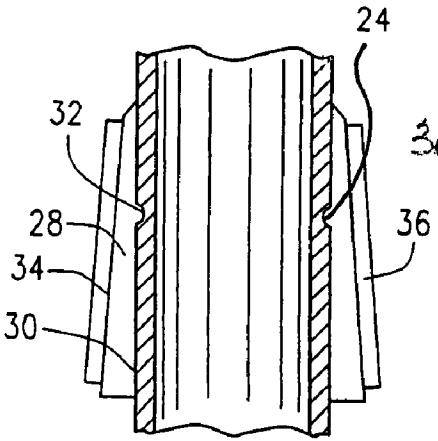
FIG. 2 is a vertical cross-sectional view of a support post and a coupling member for engaging the support post and for carrying a mounting bracket of the sign holder.

More particularly as shown in FIG. 2, each structure 26 includes a two-part split sleeve 28, each part of which is formed to embrace a portion of one post. Each sleeve 28 has an inner cylindrical surface 30 with an annular bead 32 that can be is received within an annular groove 24 to selectively position the sleeve 28 on the post 20. The sleeve 28 also has an outer downwardly tapered surface 34 that can be engaged by a conical collar 36 that is secured to a shelf, for example by welding. As the shelf is loaded, the collar 36 is caused to move downwardly over the sleeve 28, such that the collar 36 urges the sleeve 28 radially inward toward the post thereby to secure the collar to the post.

Figure 3:
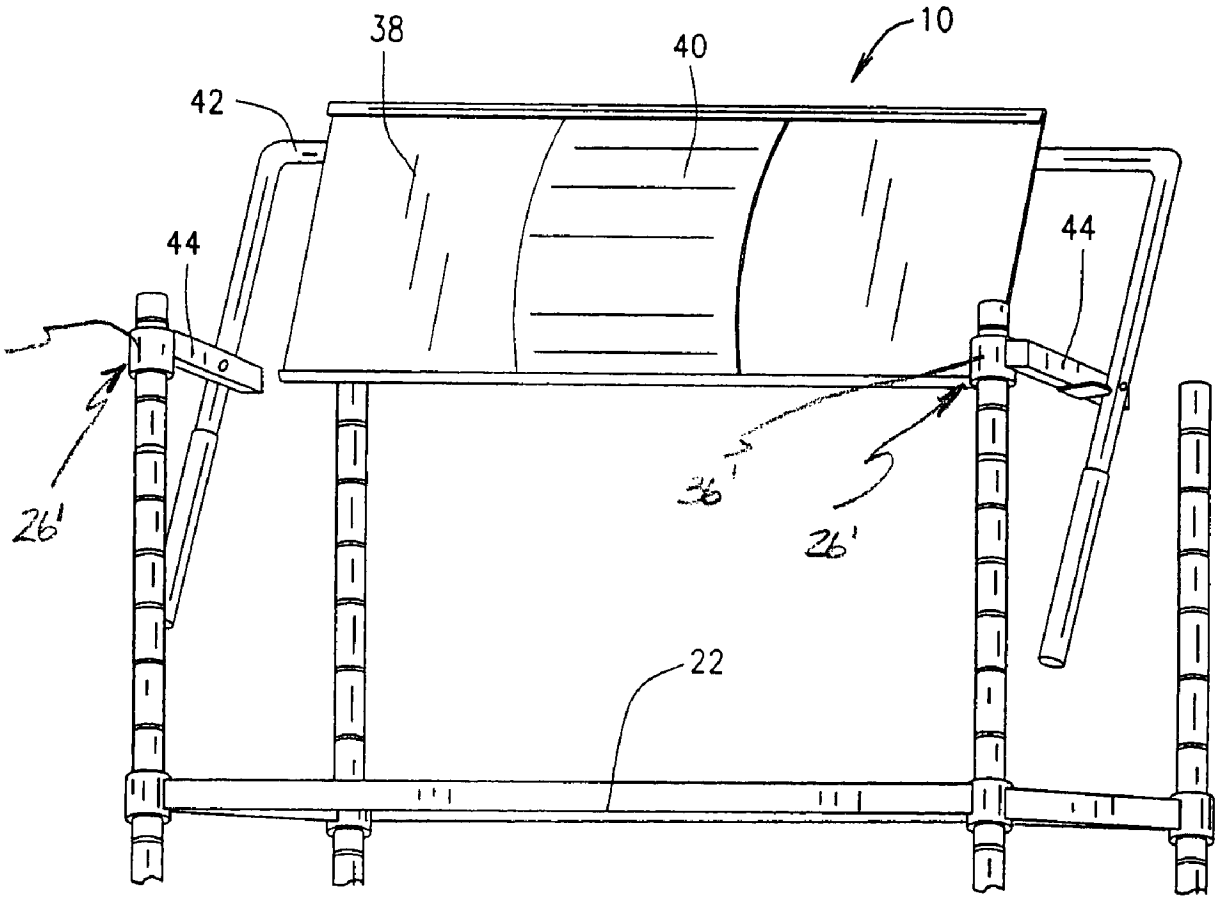
FIG. 3 is a perspective view of the sign holder of FIG. 1 moved to a second position.

As can be seen in FIGS. 1 and 3, the sign holder 10 in accordance with the invention includes a signboard 38 for holding a sign 40. The sign holder 10 is pivotably coupled to an arm 42. The arm 42 in turn is pivotably coupled to a pair of mounting brackets 44, each of which is mounted on one of the support posts 20 using a split sleeve-conical collar structure 26 such as described above. The sign holder 10 may be moved between two positions: a first position wherein the signboard 38 is positioned in front of the forward-most pair of posts 20, as shown in FIG. 1, and a second position wherein the signboard 38 is positioned above and behind those forward-most posts 20', as shown in FIG. 3. When in the first position, the signboard 38 may be easily viewed by an individual facing the workstation 12. When in the second position, the signboard 38 is suspended toward the rear of the work station to provide additional workspace.

Figure 4:
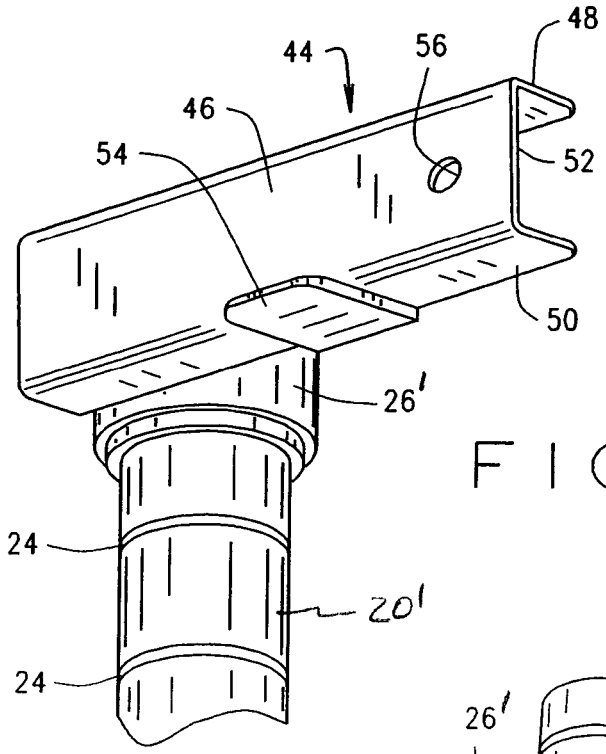
FIG. 4 is a perspective view of the mounting bracket secured to the coupling member shown in FIG. 2.
Figure 5:
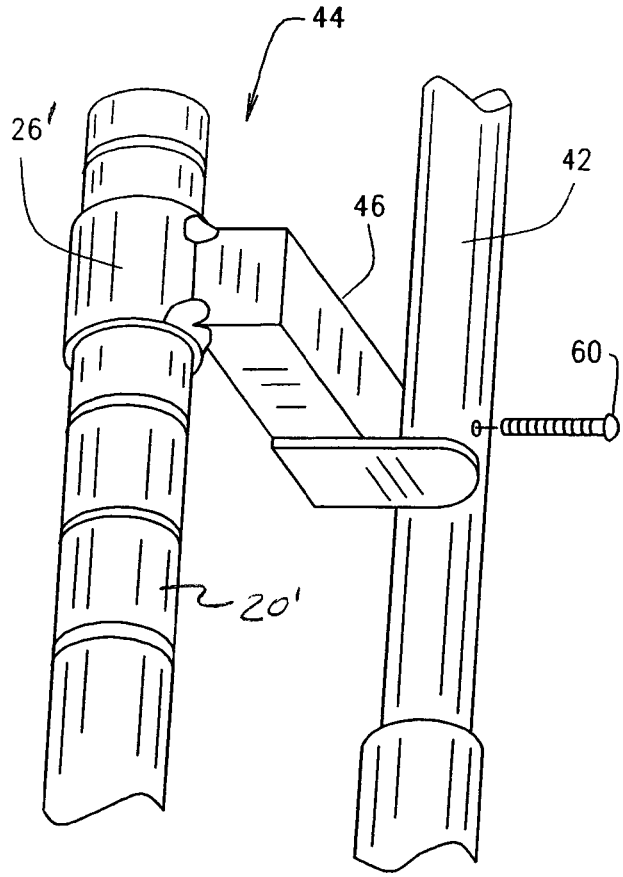
FIG. 5 is a perspective view of the exemplary sign holder of FIG. 1 partially exploded to illustrate the coupling between an arm of the sign holder and the mounting bracket.

More particularly, as seen in FIG. 4 and FIG. 5, each bracket 44 comprises an extension 46 attached, for example, by welding, to a conical collar 36' comprising a support structure 26', which, in turn, is used to mount the bracket on a post. The extension 46 has a C-shaped vertical cross-section defined by a top web 48, a parallel bottom web 50 and an interconnecting intermediate web 52. An arm restraint 54 projects from the extension 46 of each bracket and operates to support the arm 42 when the sign holder 10 is pivoted to the first position and acts as a stop for the arm 42 when the sign holder 10 is in the second position as shown in FIG. 5.

The intermediate web 52 of the extension 46 has a hole 56 which corresponds to a hole 58 formed in the arm 42 as shown in FIG. 5. The arm 42 is pivotably coupled to the bracket 44 by a pivot pin 60, which passes through the hole 56 and hole 58. The pin 60 may be a screw, bolt, rivet, or any other similar device capable of permitting pivotal motion of the arm 42 with respect to the bracket 44. Any other pivot structure may also be used.

Figure 6:
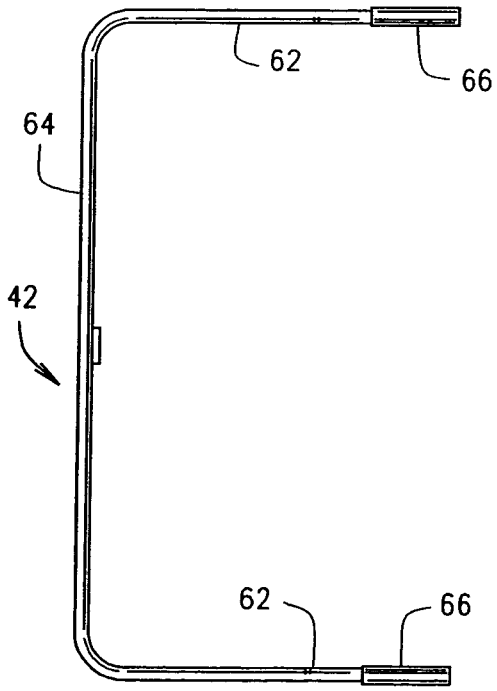
FIG. 6 is a top plan view of the arm that forms part of the sign holder shown in FIG. 1.

Turning now to FIG. 6, the arm 42 has a U-shaped configuration, is cylindrical in radial cross-section, and includes a pair of side portions 62 and a central portion 64 joining them. The central portion 64 has a length longer than the length of the signboard 38 such that the pair of side portions 62 extend outwardly beyond the sides of the signboard 38 and the posts 20' for easy access to the side portions 62. Each of the side portions 62 has a length sufficient to permit the signboard 38 to be pivoted without contacting the posts 20' as can be seen in FIG. 3. This configuration also provides unobstructed access to the shelves 22, particularly when the sign holder is in the second position shown in FIG. 3. A handle 66 may be carried on an extreme of each of the side portions 62 of the arm 42, and can be made of any of a variety of materials such as foam, dipped resin, rubber or other similar materials.

Figure 7:
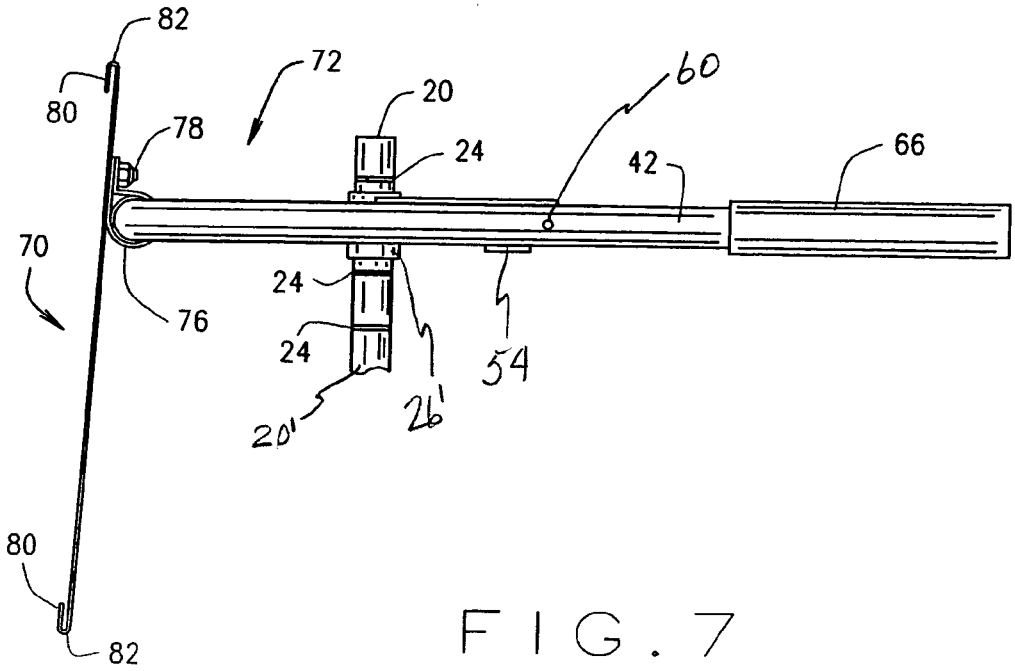
FIG. 7 is a side elevational view of the sign holder shown in FIG. 1.
Figure 8:
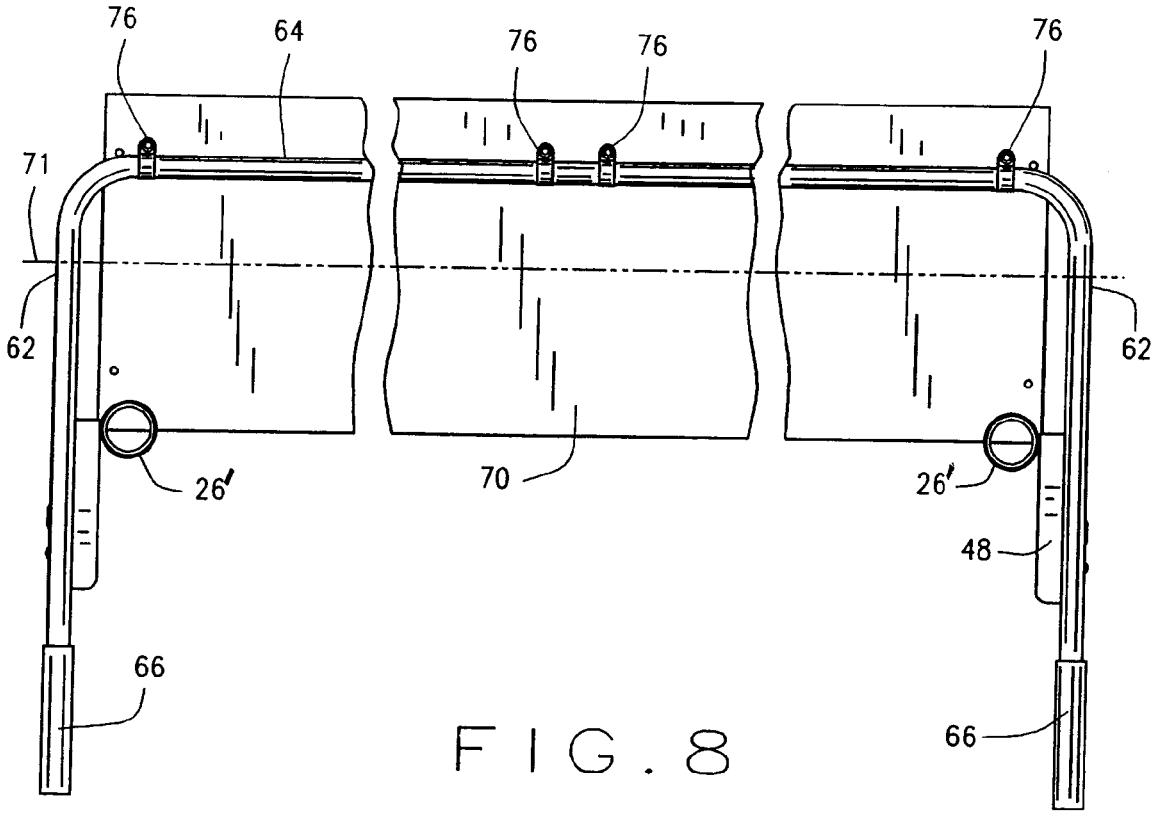
FIG. 8 is a top plan view of the exemplary sign holder of FIG. 1 with the signboard rotated under the arm.

As seen in FIGS. 7 and 8, the signboard 38 has a planar portion 70 having a centerline illustrated as the dashed line 71.

The signboard 38 is connected to the central portion 64 of the arm 42 via at least one cylindrical cuff 76. With particular reference to FIG. 8, in the preferred embodiment the signboard 38 is fixed to the central portion 64 of the arm 42 by four such cuffs 76. Spacing the cylindrical cuffs near the end portions of the arm 42 prevents the signboard 38 from sliding back and forth along the arm 42. Each cylindrical cuff 76 can be affixed to the signboard 38 by a threaded fastener 78 such as a nut and bolt, or screw. Alternatively, each cylindrical cuff may be attached by a weld, or other similar attachment means. Preferably, each cylindrical cuff 76 is affixed above the centerline 71 of the signboard 38 so that when the sign holder is in the first or second position as shown respectively in FIGS. 1 and 7 and in FIG. 3, the weight of the signboard causes it to be oriented in a generally vertical attitude. This configuration, then, permits easy reference to the signboard 38 when the sign holder 10 is set in either the first position or the second position. Alternatively, the signboard 38 may be modified to add a separate weight below locations at which it is attached to the cuffs 76 to achieve the same result. Other structures that would enable the signboard 38 to rotate with respect to the support arm 42 may also be used in place of the cylindrical cuffs 76.

The signboard 38 also includes a pair of rails 80 each defining a channel 82, both opening toward the centerline 71, for receipt of the sign 40. Preferably, the rails 80 are formed integrally with the planar portion 70 and extend horizontally and in parallel to one another. The top and bottom edges of a sign 40 may be inserted into the channels 82 by sliding the sign 40 laterally into the channels 82. In an alterative embodiment, the signboard 38 can have information printed, adhered, or painted directly on it, thus dispensing with the need for the rails 80 to provide many of the advantages of the present invention while further reducing cost.

Figure 9:
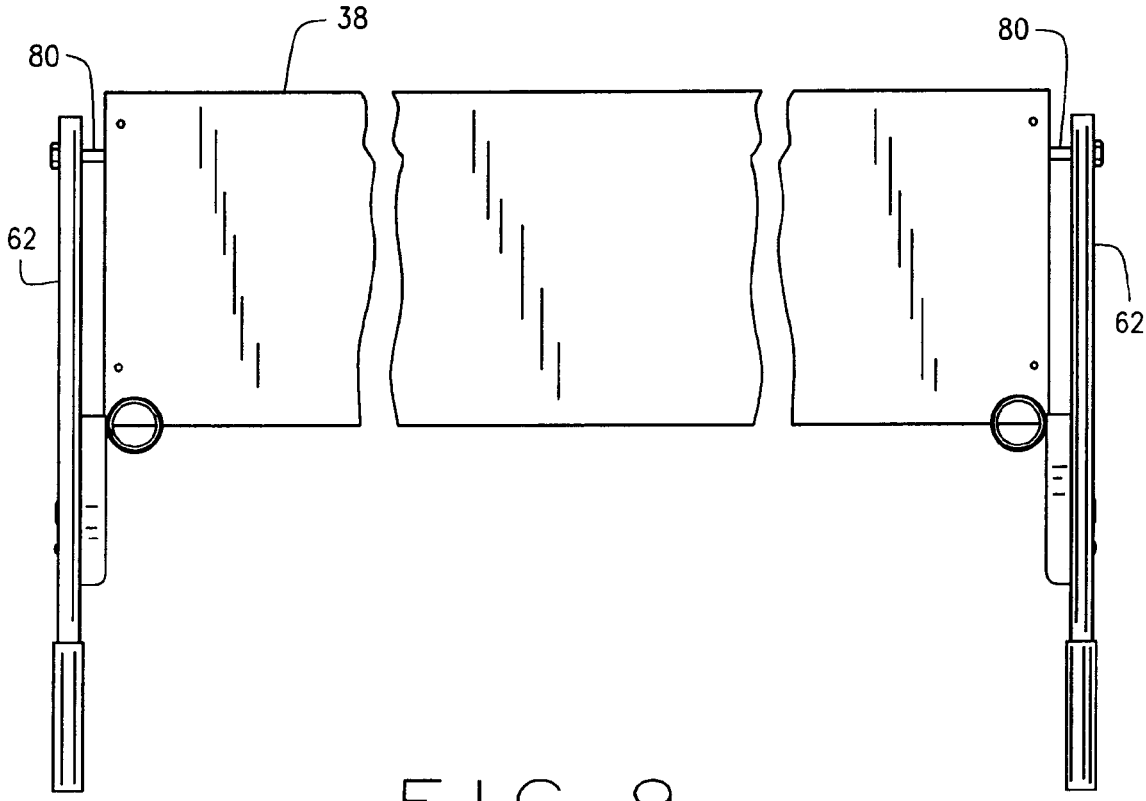
FIG. 9 is a top plan view of an alternative embodiment of a sign holder in accordance with the present invention having the signboard rotated under the arm.

In an alternative embodiment shown in FIG. 9, the signboard 38 may be coupled to the posts 20 by a pair of arms 42 in which a separate shaft 80 is substituted for the central portion 64 and is interconnected between the side portions 62.

The sign holder in accordance with the present invention as described above can be operated as follows: The user may move the signboard 38 to the first position closer to the front of the workstation 12 by pivoting the arm 42 about the pins 60 such that the signboard 38 is in front of the forward-most posts 20', as shown in FIG. 1. As can be seen in FIGS. 1 and 7, the arm restraints 54 on each mounting bracket 44 are located between the pivot pin 60 and the signboard 38 when the signboard 38 is in this first position. Therefore, those restraints support the side portions 62 of the arm 42 in a horizontal attitude thereby to hold the signboard as shown in those Figures prominently in view of a user at the front of the tabletop 18.

Alternatively, the user may rotate the arm 42 backwardly away from the front of the workstation until the side portions 60 engage the restraints 54 as shown in FIG. 3 such that the signboard 38 is suspended behind the two forward-most posts 20' and the two rearward-most posts, and out of the way in the second position. Again, each restraint 54 is located forward of the pivot pin 60 on the bracket extension 46. This configuration permits the arm 42 to rotate backwardly beyond a vertical orientation so that the weight of the signboard 38 maintains the arm 42 in the second position. Thus, in the second position the signboard remains clearly visible but is located so as to provide relatively more unobstructed workspace on the tabletop 18.

In either the first position or the second position the sign holder 10 and the sign 40 attached thereto are located above the work workstation 12 to reduce the likelihood that the sign 40 will become soiled or damaged. In addition, supporting the sign 40 above the tabletop 18 prevents the sign 40 from being hidden behind other objects located on the tabletop 18 thereby increasing the sign's visibility.

The sign 40 can be removably retained by the signboard 38 within the channels 82, thus eliminating the need for glue, magnets, hook-and-eye fasteners, adhesive or similar means to achieve sign mounting. In fast food establishments, this allows the display of different signs as needed to convey different messages.

Those skilled in the art can now appreciate from the foregoing description that the broad teachings of the present invention can be implemented in a variety of forms. Therefore, while this invention has been described in connection with particular examples thereof, the true scope of the invention should not be so limited because other modifications will become apparent to the skilled practitioner upon a study of the drawings, the specification and the following claims.

What is claimed is:

1. A sign holder for displaying a sign, said sign holder comprising:

two support posts spaced from each other in generally parallel relation;

a support structure including a bracket associated with at least one of said support posts;

an arm mounted with said bracket for movement between a first position and a second position, said arm being configured to span the distance between said support posts and mounted relative to said support posts at locations outside of the space defined between said support posts, said bracket including an arm restraining member for restraining said arm at said first position when moved thereto; and a signboard pivotably mounted with said arm to be oriented in the same generally vertical attitude when said arm is moved between the first position and the second position, said arm thereby being configured to locate said signboard in the vertical attitude for prominent viewing relative to said support structure when in said first position and to retract said signboard in the vertical attitude from the location for prominent viewing when in the second position.

2. The sign holder as recited in claim 1, wherein said signboard further comprises:

a sign-carrying portion; and a pair of elongate rails extending generally parallel relative to one another along said sign-carrying portion, each elongate rail defining a channel, said channels being configured to receive opposing edges of a sign.

3. The sign holder as recited in claim 1, wherein said signboard includes a generally planar portion and wherein said sign holder further comprises means for pivotably mounting said signboard with said arm at a location spaced from the center of mass of said generally planar portion, whereby said generally planar portion normally pivots to the generally vertical attitude.

4. The sign holder as recited in claim 1, wherein said arm comprises at least one side portion and a central portion connected to said side portion.

5. The sign holder as recited in claim 4, further comprising a handle disposed at a location of side portion of said arm spaced from said central portion.

6. The sign holder as recited in claim 1, wherein said support structure further comprises:

coupling means; and wherein said bracket extends from said coupling means.

7. The sign holder as recited in claim 6, wherein said coupling means comprises:

a sleeve formed to embrace the outer surface of one of said support posts and having an outer, downwardly outwardly tapered surface; and a flared collar formed to mate with the outer surface of said sleeve to urge said sleeve toward said support post.

8. The sign holder as recited in claim 1, wherein said restraining member is configured for restraining said arm at said second position when moved thereto.

9. The sign holder as recited in claim 1, further comprising pivot means for mounting said arm with said bracket for pivoted movement between the first and second positions.

10. The sign holder as recited in claim 1, wherein said arm includes a central portion and two side portions each extending from an opposing extreme of said central portion, and wherein each said side portion is mounted relative to one said support post.

11. A sign holder for displaying a sign, said sign holder comprising:

two support posts spaced from each other in generally parallel relation;

at least one support including a bracket;

means adapted to secure said support to at least one of said support posts;

an arm;

means for interconnecting said arm to said bracket for pivoted movement between a first position and a second position, said arm being configured to span the distance between said support posts and mounted relative to said support posts at locations outside of the space defined between said support posts, said bracket including an arm restraining member for restraining said arm at said first position when moved thereto and at said second position when moved thereto;

a signboard; and means for pivotably connecting said signboard to said arm to orient said signboard in the same generally vertical attitude when said arm is pivoted between the first position and the second position.

12. The sign holder as recited in claim 11, wherein said signboard further comprises:

a generally planar portion; and a pair of elongate rails extending parallel to one another along said generally planar portion, each elongate rail defining a channel, said channels being configured to receive opposing edges of said sign.

13. The sign holder as recited in claim 11, wherein said signboard comprises a generally planar portion, and wherein said means for pivotably mounting said signboard with said arm so mounts said signboard at a location spaced from the center of mass of said generally planar portion, whereby said generally planar portion normally pivots to the generally vertical attitude.

14. The sign holder as recited in claim 11, wherein said arm further comprises a pair of sides, and a central portion connected between said pair of sides.

15. The sign holder as recited in claim 14, further comprising a handle disposed on each of said sides at a location spaced from said central portion.

16. The sign holder as recited in claim 11, wherein said support further comprises:

a coupling member; and wherein said bracket extends from said coupling member.

17. The sign holder as recited in claim 16, wherein said bracket is formed with a hole and said arm is formed with a hole, and wherein said means for pivotably connecting said arm to said bracket comprises a pin received in said hole in said bracket and said hole in said arm to permit rotational movement between said bracket and said arm.

18. The sign holder as recited in claim 16, wherein said coupling member further comprises:

a sleeve formed to embrace the outer surface of one of said support post and having an outer, downwardly outwardly tapered surface; and a flared collar formed to mate with the outer surface of said sleeve to urge said sleeve toward said support post.

19. An work station assembly comprising:

a table having a tabletop;

two support posts extending upwardly from said tabletop and spaced from each other in generally parallel relation;

a sign holder for displaying a sign above said tabletop, said sign holder comprising (a) at least one support including a bracket and being mounted with at least one of said support posts, (b) an arm pivotably coupled to said bracket, said arm being configured to span the distance between said support posts and mounted relative to said support posts at locations outside of the space defined between said support posts, and (c) a signboard coupled to said arm, said arm being coupled to said bracket for said pivoted movement between a first position for prominent location of said signboard relative to said tabletop and a second position for retracted location of said signboard from said prominent location, said signboard being pivotably coupled to said arm to be oriented in the same generally vertical attitude when said arm is moved between the first position and the second position; said bracket further comprising a restraining member for restraining said arm at said first position when moved thereto and at said second position when moved thereto.

20. The work station as recited in claim 19, wherein said signboard further comprises:

a generally planar portion; and a pair of elongate rails extending generally parallel to one another, each elongate rail defining a channel along said generally planar portion, said channels being configured to receive opposing edges of a sign.

21. The work station as recited in claim 19, wherein said arm further comprises a pair of sides, and a central portion connected between said pair of sides.

22. The work station as recited in claim 21, further comprising a handle disposed on each of said sides at a location spaced from said central portion.

23. The work station as recited in claim 19, wherein said signboard further comprises a generally planar portion, and said sign holder further comprises means for pivotably mounting said signboard with said arm at a location spaced from the center of mass of said generally planar portion, whereby said generally planar portion normally pivots to the generally vertical attitude.

24. The work station as recited in claim 19, wherein said support further comprises:

a coupling member; and wherein said bracket extends from said coupling member.

25. The work station as recited in claim 24, wherein said bracket is formed with a hole and said arm is formed with a hole, and wherein said means for pivotably connecting said arm to said bracket comprises a pin received in said hole in said bracket and said hole in said arm to permit rotational movement between said bracket and said arm.

26. The work station as recited in claim 24, wherein said coupling member further comprises:

a sleeve formed to embrace the outer surface of at least one of said support posts and having an outer, downwardly outwardly tapered surface; and a flared collar formed to mate with the outer surface of said sleeve to urge said sleeve toward said support post.

27. An assembly comprising:

a table having a work surface and four support posts extending upwardly from said work surface, said posts supporting at least one shelf, said shelf including four coupling members, each said coupling member being configured to couple to a corresponding post; and a sign holder for displaying a sign, said sign holder comprising a pair of support brackets, coupling means for coupling each said bracket with one of said posts, a U-shaped arm pivotably connected to said brackets, a signboard pivotably connected to said arm, wherein said arm is pivotable between a first position where said signboard is proximate said table and a second position where said signboard is distant from said table, said signboard being pivotly connected to said arm to be oriented in the same generally vertical attitude when said arm is pivoted between the first position and the second position, means for restraining said arm at said first position; and means for restraining said arm at said second position.

28. A sign holder for displaying a sign and adapted to be mounted with two support posts spaced from each other in generally parallel relation, said sign holder comprising;

a support structure configured for association with at least one of the support posts;

an arm configured to span the distance between the support posts and to be mounted relative to the support posts at a location outside of the space defined between the support posts;

reduced friction means for mounting said arm with said support structure for pivoted movement between a first position and a second position;

arm restraining means for restraining said arm at said first position when moved thereto and for restraining said arm at said second position when moved thereto; and a signboard pivotably mounted with said arm to be oriented in the same generally vertical attitude when said arm is moved between the first position and the second position, said arm thereby being configured to locate said signboard for prominent viewing relative to said support structure when in said first position and to retract said signboard from the location for prominent viewing when in the second position.

* * * * *

UNITED STATES PATENT AND TRADEMARK OFFICE

CERTIFICATE OF CORRECTION

PATENT NO. : 7,143,534 B2
APPLICATION NO. : 10/702474
DATED : December 5, 2006
INVENTOR(S) : Douglad J. Kaminski It is certified that error appears in the above-identified patent and that said Letters Patent is hereby corrected as shown below:

COLUMN 2

Line 2, "fail," should read --fails,--; and
Line 38, "be" should be deleted.

COLUMN 8

Line 17, "post" should read --posts--; and
Line 21, "An" should read --A--.

Signed and Sealed this

Thirty-first Day of July, 2007

JON W. DUDAS
*Director of the United States Patent and Trademark Office*